US005787515A

United States Patent [19]

Mason et al.

[11] Patent Number: 5,787,515

[45] Date of Patent: Aug. 4, 1998

[54] ASSIST DEVICE FOR USE WITH SEATING MEANS SUCH AS COMMODE, CHAIR AND THE LIKE

[76] Inventors: Kenneth H. Mason, 74 Rollingwood Circle, London, Ont., Canada, N6G 1P7; Perry R. Palen, RR #2, Utopia, Ontario, Canada, L0M 1T0

[21] Appl. No.: 762,596

[22] Filed: Dec. 9, 1996

Related U.S. Application Data

[60] Provisional application No. 60/022,414 Jul. 30, 1996.

[51] Int. Cl. [6] ..... A47K 17/02

[52] U.S. Cl. ..... 4/254; 4/480; 297/217.7; 5/604; 5/84.1

[58] Field of Search ..... 4/667, 479, 480, 4/483, 254, 560.1; 297/217.7; 5/81.1 R, 83.1, 84.1, 85.1, 87.1, 604, 658; 135/66, 74

[56] References Cited

U.S. PATENT DOCUMENTS

| | | | |
|---|---|---|---|
| 3,047,884 | 8/1962 | Grondona | 4/254 |
| 3,405,411 | 10/1968 | Brown | 4/254 |
| 4,031,576 | 6/1977 | Epstein | 4/251 |
| 4,196,480 | 4/1980 | Guenther et al. | 4/254 |
| 4,214,323 | 7/1980 | Thomas | 4/237 |
| 4,334,330 | 6/1982 | Marshall | 5/604 |
| 4,613,994 | 9/1986 | Oates | 4/480 |
| 4,715,069 | 12/1987 | James | 4/254 |
| 4,843,661 | 7/1989 | Skibinski | 5/81 |
| 4,884,841 | 12/1989 | Holley | 297/331 |
| 4,894,871 | 1/1990 | Schmerler | 4/254 |
| 4,922,560 | 5/1990 | Skjbinski | 5/81 |
| 4,964,182 | 10/1990 | Schmerler | 5/81.1 R |
| 5,023,962 | 6/1991 | Steljes | 4/480 |
| 5,148,559 | 9/1992 | Morris | 4/483 |
| 5,195,200 | 3/1993 | Leoutsakos | 5/658 |
| 5,226,439 | 7/1993 | O'Keeffe et al. | 4/254 |
| 5,303,430 | 4/1994 | Fernie et al. | 4/254 |
| 5,465,744 | 11/1995 | Browning | 135/67 |

FOREIGN PATENT DOCUMENTS

| | | | |
|---|---|---|---|
| 520268 | 12/1992 | European Pat. Off. | 4/254 |
| 2018128 | 10/1979 | United Kingdom | 4/254 |

*Primary Examiner*—Charles R. Eloshway

[57] ABSTRACT

The assist device comprises a gate rotatable about a horizontal axis and attached to a vertical frame, which forms a protective enclosure around an infirm person when wishing to sit down or rise from a seat. The vertical frame is connected to a base which holds securely the seating accommodation. The base further incorporates structure to anchor the assist device to a heavier piece of furniture. The device can be operated by an infirm person with no or little assistance by another.

11 Claims, 3 Drawing Sheets

ASSIST DEVICE FOR USE WITH SEATING MEANS SUCH AS COMMODE, CHAIR AND THE LIKE

This application claims the benefit of U.S. Provisional Application No. 60/022,414, filed Jul. 30, 1996.

FIELD OF INVENTION

This invention relates to a device for assisting the elderly and infirm when using everyday household furniture and more particularly to a portable assist device to be used in conjunction with a seating accommodation.

BACKGROUND OF THE INVENTION

The elderly, the infirm and others who are either temporarily or permanently restricted in their movements often require assistance when they intend to sit down or rise from a seat. Buildings such as hospitals, nursing homes and such like are usually equipped with railings, handles and similar devices which are permanent fixtures, to facilitate movement by the infirm. However, domestic furniture or similar household items, which themselves may be portable or movable, usually have no additional support devices or similar means. In such instances another person is required to be within easy reach to accommodate the needs of an elderly or infirm person. Such needs may be particularly cumbersome and in some cases embarrassing, when the use of a commode or toilet by an elderly or infirm person requires the assistance or attendance of another more able-bodied person.

There are known devices which will assist in moving a patient or an invalid from a lying position to a sitting or standing position, or transferring an invalid from a supine position to a sitting position in a wheelchair, with relatively little or no effort on behalf of the invalid, but such devices are usually to be operated by another person.

Disabled, elderly or infirm persons, who may be able to move on level ground unassisted, or with the aid of what is known as a 'walker', may not be able to lower themselves onto a seat without the assistance of another person, nor be able to rise alone from a sitting position to a standing position. This problem may be particularly acute when an elderly or infirm person wishes to use a commode or a similar installation without the assistance of another person. Furthermore, the elderly or infirm may frequently stumble or temporarily lose physical stability, and hence the equipment or fixture assisting in changing his or her position needs to be firm, yet in some respects, have sufficient flexibility to avoid injury or damage to the person it aids or supports.

A device having handles designed to provide support, and a raised toilet seat which can be temporarily or permanently mounted on a commode or toilet seat, is described in U.S. Pat. No. 4,214,323 issued to M. I. Thomas on Jul. 29, 1980. It appears, however, that the use of such raised toilet seat would still require the assistance of another person.

In another approach a support structure is mounted over a toilet seat which has armrests supporting a seated person and assisting them in rising from the seat. Such a structure is described, for example in U.S. Pat. No. 4,031,576, issued to H. C. Epstein on Jun. 28, 1977, wherein a pair of angled armrests mounted on a frame are operated by spring biassing. The armrests can slide in the vertical direction by means of a spring in co-operation with a backrest, thereby assisting the person to lower themselves onto the seat and rise from it. Another example of a seating assistance device is described in U.S. Pat. No. 4,884,841, issued to R. E. Holley on Dec. 5, 1989, having a hinged seat attached to a frame which also has armrests rigidly and integrally mounted on the same. The seat is moved downward by gravity, and mechanical, hydraulic or electrical means is utilized to move the seat vertically and thereby assist the user to rise. In the above devices the supporting armrests operate in conjunction with a seat and are located only on the sides of the user, without any support provided in front of the seat. Furthermore, an infirm user may still require the assistance of another person to guide them into a position in which the support of the armrests can be engaged.

A portable device to assist a person rising from a seated position is described in U.S. Pat. Nos. 4,843,661 and 4,922,560, issued to B. J. Skibinski, on Jul. 4, 1989 and May 8, 1990, respectively. The device comprises a pair of handles mounted on a flat unanchored platform, which can be moved from a horizontal to a vertical plane. The handles are in parallel vertical planes when assistance in rising is required, and are mounted such that a person, usually the user, can walk between the vertical planes they occupy. The handles are folded down on the platform in a horizontal position when not in use. The use of this foldable device in conjunction with a commode, however, may present notable difficulties for the infirm, such as tripping over the edges of the platform or the platform being unanchored.

A bedside commode station is described in U.S. Pat. No. 5,023,962, issued to R. C. Steljes on Jun. 18, 1991. The commode consists of a container and a seat set in a frame which are mounted on a platform, and a handrail is mounted adjacent to the commode. The handrail is made of rigid tubular sections joined at right angles, supported by vertical members mounted on the platform. One section of the handrail runs along the side of the frame of the commode, and the other section is located in front of the seat. One of the difficulties that may arise with this device is that the space provided between the seat and the front section of the handrail is not adjustable to individual needs, nor is it flexible and may restrict the movement of the user of the commode. Moreover, should the invalid or infirm person slip or lose their balance, they may be damaged by the rigid structure of the handrail.

There is a need for a device or apparatus that an infirm elderly or disabled person may use to assist in sitting down or rising from a seat, in particular a commode or a portable toilet seat, which is protective but not restrictive, may be anchored to heavier pieces of furniture and can safely be used in the absence of another person's assistance. Such a device would assist in retaining independence and self respect, and prevent loss of human dignity of an elderly or infirm person, and at the same time reduce the cost of caring.

SUMMARY OF THE INVENTION

A portable assist device has now been invented for use in co-operation with a seating accommodation allowing a person to sit down securely or rise from the seating accommodation without requiring the attendance of another person. The portable assist device for operation in conjunction with a seating means having a plurality legs, comprises:

i) a gate rotatable about a horizontal axis and movable between a horizontal and a vertical position, said gate comprising a unitary bar having two sections, said bar sections enclosing an angle greater than 85° between them and having an adjoined bar-weight support member for providing support to said unitary bar;

ii) said gate being hingedly connected to a vertical frame member for rotation about said horizontal axis, said vertical frame supporting said gate in the vertical position, and supporting said bar-weight support member when said gate is in the horizontal position; and iii) bracket means for engaging the legs of said seating means, said bracket means having a first horizontal member of adjustable length connecting said bracket means to said vertical frame member and to a second horizontal member for anchoring said portable assist device.

The portable assist device can be engaged with another piece of furniture, such as a bed or a chair of substantial weight and stability, to anchor the seating accommodation in co-operation with the portable assist device.

In another embodiment the portable assist device in cooperation with a seating accommodation and anchored to another piece of furniture provides a connecting base for an overhead support structure.

The preferred embodiments of the invention will be described hereinbelow with reference to the drawings.

DESCRIPTION OF THE PREFERRED EMBODIMENTS

It is known that a chair or commode can tip when an unsteady or infirm person tries to use it for support, in particular when the unsteady person attempts to sit down or to rise from the chair or commode. Moreover, such tipping is more likely to take place when the unsteady or infirm or elderly person is moving from a bed to a commode or chair, or is rising from the commode or chair to return to bed. An arrangement which provides some form of hand holds and means of support located in the proximity of the bed may eliminate unnecessary movement or reduce movement required by a user to a minimum, moreover, structural elements which anchor the commode or chair so that it cannot tip, will enhance the confidence of the unsteady person and diminish the risk of serious injury by falling. Furthermore, the need for the attendance of a more able-bodied person may be reduced and the unsteady or infirm person may gain more independence.

The present invention is intended to provide an infirm person with a portable assist device in the form of a flexible enclosure which comprises a portable and stable base for the commode or the chair, the base being also equipped to anchor the device to a bed or another piece of heavy furniture, and a vertical post with a hinged, substantially L-shaped gate creating a small enclosure. The gate is hinged so that it can be lifted out of the way into a vertical position when it is not needed and lowered to take up a horizontal position when assistance and support of the infirm person is required.

The portable assist device in accordance with the present invention includes a base which rests on the floor and is constructed from 2 or 3 pieces joined together by welding, bolting or similar manner. The assist device can be attached to a chair or commode only, but the preferred embodiment also comprises an additional horizontal flat piece, usually made of metal, for anchoring the base to another relatively heavy piece of furniture, such as a bed. 'Portable' in the present context is understood to mean that the assist device is not permanently attached to a commode or a chair, and may be removed to fit another seating accommodation if it is so desired.

By another aspect of the invention a detachable overhead support or console can be connected in known manner to the base. The overhead support may take the form of a rotatable vertical post having shelves or an extendible arm for further handholds to assist sitting up in the bed, or other means or devices of similar nature.

Figure 1A:
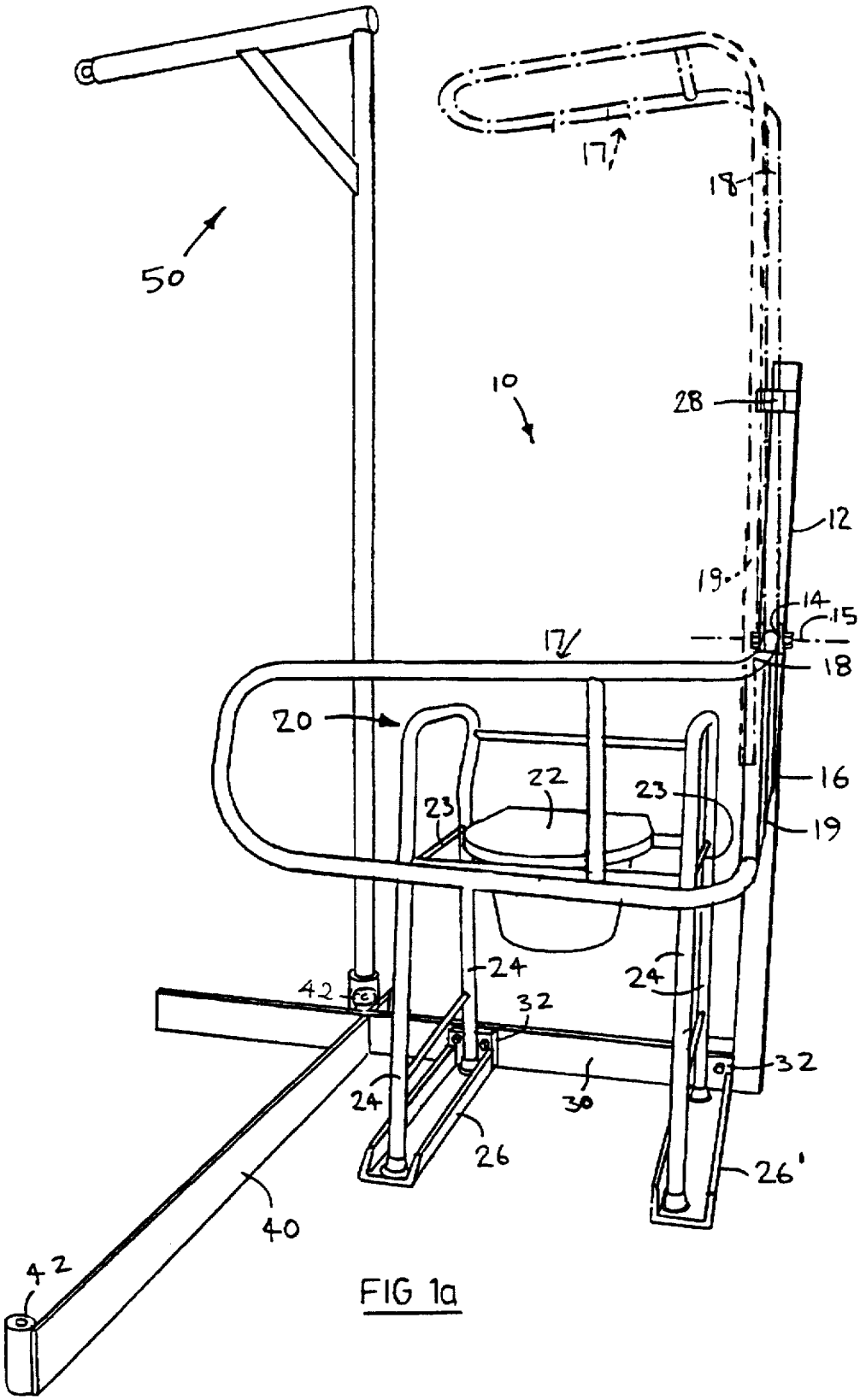
FIG. 1*a* shows schematically the assist device in accordance with the present invention, with the gate in the horizontal or down position.

FIG. 1*a* shows schematically the embodiment of the present invention incorporating a horizontal base with means to engage the legs of a seating accommodation, a vertical frame supporting a gate and means to anchor the assist device. Reference numeral 10 of FIG. 1*a* represents the assist device, having a vertical frame 12, attached to horizontal metallic bar 30. The vertical frame 12 supports a gate 17 hingedly connected to vertical frame 12 by hinge 14 so as to be pivotable about a horizontal axis 15 within hinge 14. The gate 17 is capable of rotating about the horizontal axis 15, between a vertical and horizontal position. The hinge 14 is usually located at a height above what is considered to be the anticipated waist level of the user of the seating accommodation, but the exact level of the horizontal axis 15 is dictated by convenience only.

The gate comprises a bar, rod or tubular piece 18, preferably made of a unitary piece of metal or elongated plastic, having rounded edges to reduce the likelihood of injury to the person grabbing the gate. It is not essential that the bar for gripping be a unitary piece, but it is convenient from the point of view of manufacture. The gate 17, is designed to provide an enclosure around the user, hence the bar, rod or tube is bent such that it is comprised of two sections enclosing an angle greater than 85°, the preferred range being 89° to 120°. Included in gate 17, and connected to piece 18, is bar-weight support means 19, usually but not necessarily, made of similar material as the piece 18. The bar-weight support means 19, is adjoined to bar 18, in such a manner that it leans against or is supported in a socket or similar device, 16, located on vertical frame 12, when gate 17 is in the horizontal position. A clip or similar device 28 is located close to the top of vertical frame 12, to hold the gate 17 in the vertical position when it is not in use.

Angle iron or U-shaped channels, or suitable mechanical equivalents 26 and 26', are attached to a horizontal bar 30, and connected to legs 24 of a seating accommodation 20. The seating accommodation 20 is shown to be a conventional commode in FIG. 1*a*, having a seat 22, located on a conventional frame and side arms 23, shown schematically. The seating accommodation engaged in conjunction with the assist device may also be a chair or a bench. The legs 24 of the seating accommodation 20, are securely held or attached by conventional brackets or similar means, in the U-shaped channels 26 and 26'. The method of firmly securing the legs in the channels may be dictated by convenience and will be referred to below in general terms as bracket means. It is convenient to have means included in horizontal bar 30, to adjust the length of the base to accommodate the legs of the seat which may be of different nature, shape and spacing. In other words, the legs of the commode, chair or bench may be located at different distances apart from one another and hence some adjustment in the length of horizontal bar 30, and the spacing between channels 26 and 26', may be required. Any known length adjusting means may be utilized, and such adjusting means is denoted on FIG. 1*a* by reference numeral 32. It is, however, noted that length adjusting means 32 is an optional feature and it is not an essential component of the assist device. A second horizontal metal bar 40, is joined to the horizontal metal bar 30, for placement under a bed or similar heavier item of furniture, to serve as anchoring means. The second horizontal bar 40, may be attached by chains, straps, brackets or similar known means, denoted by reference numeral 42, to the legs of the bed or the heavier piece of furniture. The attachment to the bed or another heavier piece of furniture needs not to be rigid, but may be so if it is desired.

Figure 1B:
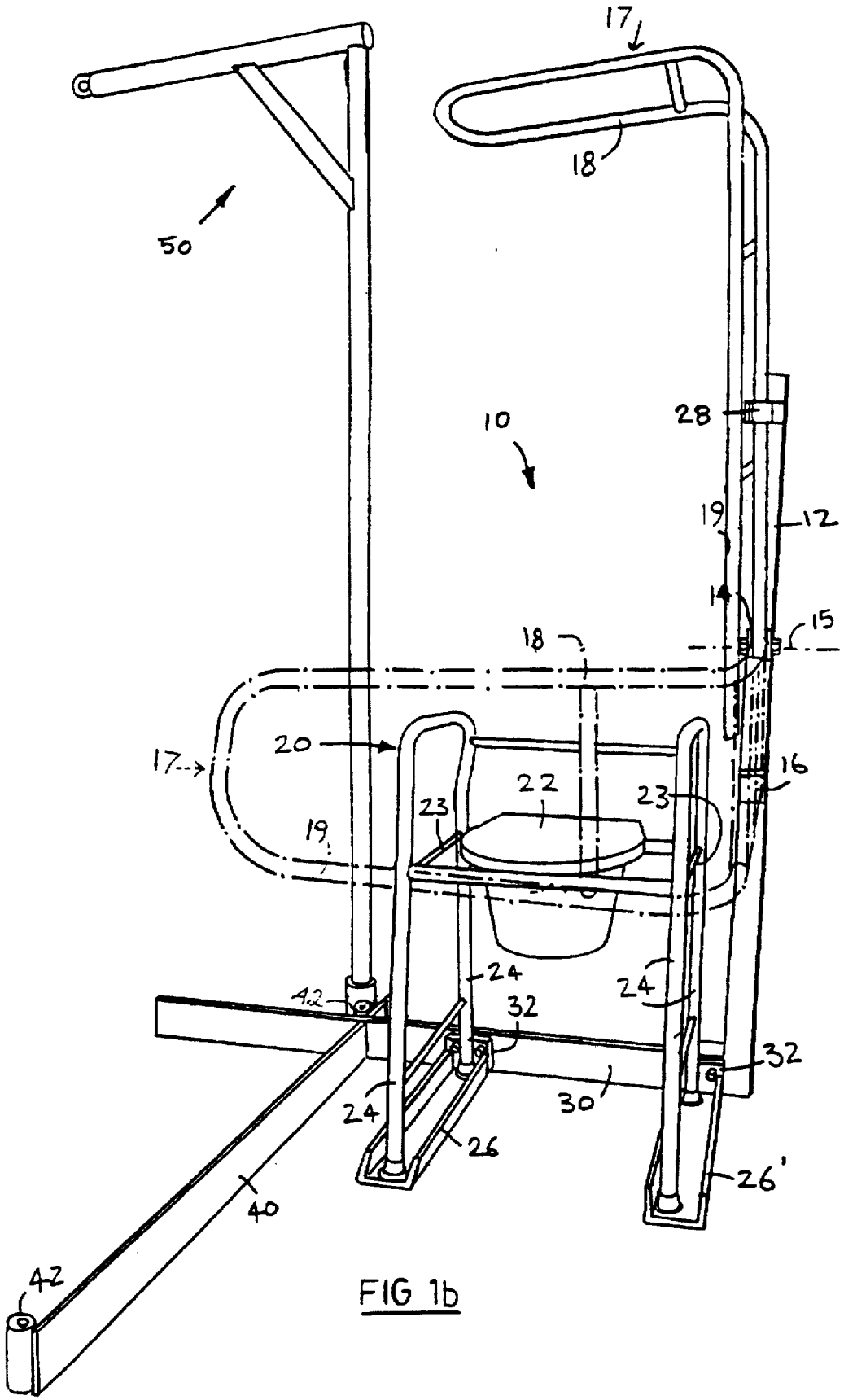
FIG. 1*b* shows the assist device schematically with the gate in the vertical or up position.

FIG. 1*a* shows gate 17 in a down or horizontal position and FIG. 1*b* shows the gate in an up or vertical position with one section of the bar leaning against the vertical frame and held in this position by clip 28.

Figure 2:
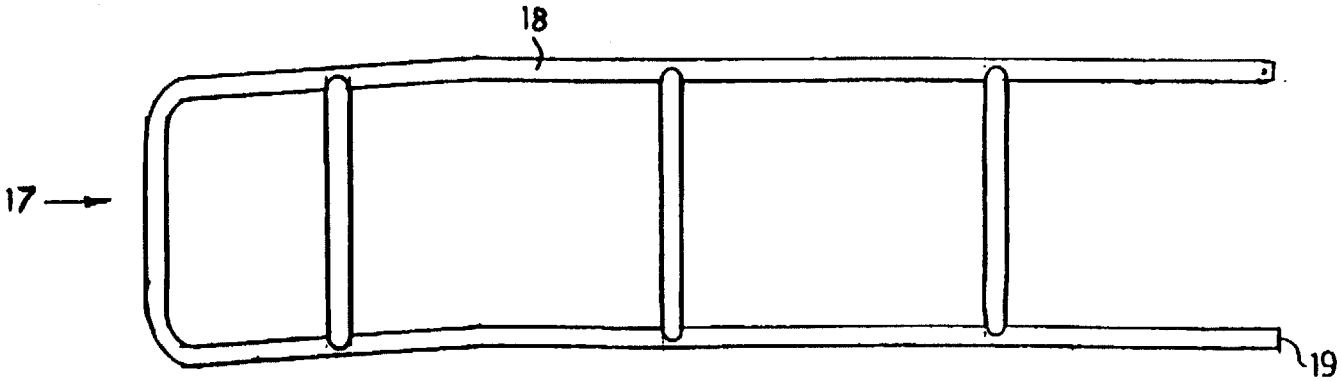
FIG. 2 is a side view of one configuration of the rotatable gate and FIG. 3 is the side view of another configuration of the rotatable gate of the present invention.
Figure 3:
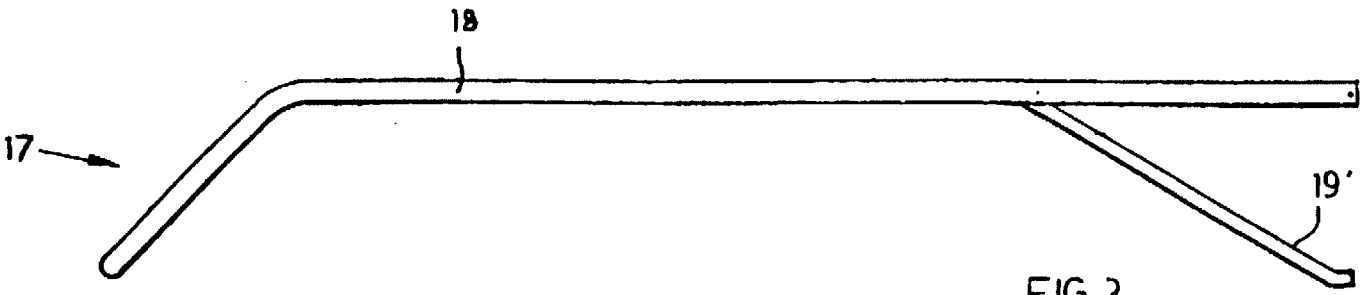

As discussed above, the gate 17 is supported in the horizontal position by bar-weight support means 19. FIG. 2 shows the gate 17 having a bar-weight support means 19 which is parallel with the bar, rod or tube 18 in gate 17, and may be conveniently manufactured by bending a unitary piece of bar, rod or tube into a 'U'-shaped configuration and subsequent bending to enclose an angle greater than 85°. Sections of metallic bar or rod may be welded between the members of the loop to render the gate structure sufficiently rigid, as is shown in FIG. 2, but other suitable configurations may also be used, as long as the gate 17 is capable of rotating about horizontal axis 15, and be supported by the vertical frame 12, in its horizontal position. Another configuration of gate 17 is shown on FIG. 3, having bar-weight support means 19' welded at an angle to the underside of bar 18.

The gate in the horizontal position also protects the user of the device from falling or sliding, as well as providing support to a person wishing to rise from the seat. As indicated above, the rest position of the gate is likely to be the vertical position and the gate may conveniently be kept secure in this vertical resting position between uses, by clip 28.

An overhead support structure may be included in the portable assist device by attaching or connecting a console or a form of a support structure to horizontal bar 30. The overhead support structure is schematically indicated by reference numeral 50, on FIG. 1*a* and on FIG. 1*b*. The nature and type of the overhead support structure or console is decided by the intended use and desired objective of the overhead support structure, such as the support of some equipment to assist the elderly, or infirm person in sitting up or getting out of bed; keeping personal items within easy reach and such like. There are several known structures on the market which may be integrated with the horizontal base of the device.

The gate, due to the manner it is designed and supported on the vertical frame, has some inherent flexibility, and thereby the user may move between the bed and the enclosure even when the gate is in the horizontal position. The flexibility feature is also intended to lessen any bodily injury if the user has a hard fall against the gate.

The seating accommodation referred to in the description above was a commode, and hence some toilet roll holding means may also be affixed to the gate. As referred to above, a chair, armchair or a bench utilizing appropriate bracket fittings can also be engaged as the seating accommodation incorporated with the assist device of this invention. Preferably, the bracket means and the channels enclosing the legs do not extend beyond the frame of the seating accommodation.

The advantages of the assist device of this invention include that it is relatively easy to assemble and operate, does not incorporate expensive and complex mechanical operating devices, and hence it may be manufactured at relatively low cost. Moreover, few parts of it are likely to develop operating faults and the device is easily adjusted to the needs of the user. Should the infirm user so desire, the assist device can be made accessible by a 'walker'.

Although the present invention has been described with reference to the drawings above, it is to be understood that modifications and variations may be resorted to without departing from the spirit and scope of the invention, as those skilled in the art readily understand. Such modifications and variations are considered to be within the purview and scope of the invention as defined by the appended claims.

We claim:

1. A portable assist device for operation in conjunction with a seating means having a plurality of legs, comprising:

i) a gate rotatable about a horizontal axis and movable between a horizontal and a vertical position, said gate comprising a unitary bar having two sections, said bar sections enclosing an angle greater than 85° between them and having an adjoined bar-weight support member for providing support to said unitary bar;

ii) said gate being hingedly connected to a vertical frame member for rotation about said horizontal axis, said vertical frame member supporting said gate at a location above said horizontal axis when said gate is in the vertical position, and supportingly contacting said bar-weight support member when said gate is in said horizontal position; and iii) bracket means for engaging the legs of said seating means, said bracket means having a first horizontal member, a plurality of secondary members, and means for adjusting the distance between said secondary members, said first horizontal member connected to said vertical frame member and to a second horizontal member for anchoring said portable assist device.

2. A portable assist device for operation in conjunction with a seating means having a plurality of legs as claimed in claim 1, wherein said seating means is selected from the group consisting of a chair, a commode, an armchair and a bench.

3. A portable assist device for operation in conjunction with a seating means having a plurality of legs as claimed in claim 1, wherein said angle enclosed by said bar sections is between 89° and 120°.

4. A portable assist device for operation in conjunction with a seating means having a plurality of legs as claimed in claim 1, wherein said bar-weight support member is adjoined to said bar such that said bar-weight support member rests against said vertical frame member below said horizontal axis hingedly connecting said gate, when said gate is in said horizontal position.

5. A portable assist device for operation in conjunction with a seating means having a plurality of legs as claimed in claim 1, wherein said secondary members each further comprising a U-shaped member.

6. A portable assist device for operation in conjunction with a seating means having a plurality of legs, comprising:

i) a gate rotatable about a horizontal axis and movable between a horizontal and a vertical position, said gate comprising a unitary bar having two sections, said bar sections enclosing an angle greater than 85° between them and having an adjoined bar-weight support member for providing support to said unitary bar;

ii) said gate being hingedly connected to a vertical frame member for rotation about said horizontal axis, said vertical frame member supporting said gate at a location above said horizontal axis when said gate is in the vertical position, and supportingly contacting said bar-weight support member when said gate is in said horizontal position;

iii) bracket means for engaging the legs of said seating means said bracket means having a first horizontal member, a plurality of secondary members, and means for adjusting the distance between said secondary members, said first horizontal member connected to said vertical frame member; and iv) a second horizontal member adapted to be anchored to a bed, and said first and second horizontal members being connected to one another.

7. A portable assist device for operation in conjunction with a seating means having a plurality of legs as claimed in claim 6, wherein said seating means is selected from the group consisting of a chair, a commode, an armchair and a bench.

8. A portable assist device for operation in conjunction with a seating means having a plurality of legs as claimed in claim 6, wherein said angle enclosed by said bar sections is between 89° and 120°.

9. A portable assist device for operation in conjunction with a seating means having a plurality of legs as claimed in claim 6, wherein said bar-weight support member is adjoined to said bar such that said bar-weight support member rests against said vertical frame member below said horizontal axis hingedly connecting said gate, when said gate is in said horizontal position.

10. A portable assist device for operation in conjunction with a seating means having a plurality of legs as claimed in claim 6, wherein said secondary members each further comprising a U-shaped member.

11. A portable assist device for operation in conjunction with a seating means having a plurality of legs comprising in combination:

i) a gate rotatable about a horizontal axis and movable between a horizontal and a vertical position, said gate comprising a unitary bar having two sections, said bar sections enclosing an angle greater than 85° between them and having an adjoined bar-weight support member for providing support to said unitary bar;

ii) a vertical frame member, said gate being hingedly connected to said vertical frame member for rotation about said horizontal axis, said vertical frame member supporting said gate at a location above said horizontal axis when said gate is in the vertical position, and supportingly contacting said bar-weight support member when said gate is in the horizontal position;

iii) bracket means for engaging the legs of said seating means, said bracket means having a first horizontal member, a plurality of secondary members, and means for adjusting the distance between said secondary members, said first horizontal member connected to said vertical frame member;

iv) a second horizontal member for anchoring said portable assist device, and said first and second horizontal members being connected to one another; and, v) an overhead support member adjoined to said first horizontal member.

* * * * *